US008296972B2

(12) United States Patent
Sato et al.

(10) Patent No.: US 8,296,972 B2
(45) Date of Patent: Oct. 30, 2012

(54) SHOE AND METHOD OF MANUFACTURING THE SAME

(75) Inventors: Natsuki Sato, Osaka (JP); Tetsuo Yamamoto, Osaka (JP); Yoshinobu Watanabe, Osaka (JP); Satoshi Kishimoto, Osaka (JP)

(73) Assignee: Mizuno Corporation, Osaka (JP)

( * ) Notice: Subject to any disclaimer, the term of this patent is extended or adjusted under 35 U.S.C. 154(b) by 464 days.

(21) Appl. No.: 12/414,141

(22) Filed: Mar. 30, 2009

(65) Prior Publication Data

US 2009/0241374 A1 Oct. 1, 2009

(51) Int. Cl.
*A43B 23/00* (2006.01)

(52) U.S. Cl. ..... 36/102; 36/51; 36/45

(58) Field of Classification Search ..... 36/102, 36/51, 45, 54, 9 R
See application file for complete search history.

(56) References Cited

U.S. PATENT DOCUMENTS

| | | | | |
|---|---|---|---|---|
| 2,158,153 | A * | 5/1939 | Roberts et al. | 12/142 E |
| 2,269,923 | A * | 1/1942 | Vamos | 442/76 |
| 4,069,515 | A * | 1/1978 | Swallow et al. | 2/239 |
| 4,317,292 | A * | 3/1982 | Melton | 36/9 R |
| 5,351,352 | A * | 10/1994 | Chillemi | 12/146 C |
| 5,765,296 | A | 6/1998 | Ludemann et al. | |
| 5,932,056 | A * | 8/1999 | Mark et al. | 156/266 |
| 7,028,421 | B2 * | 4/2006 | Galeyev | 36/115 |
| 7,051,460 | B2 * | 5/2006 | Orei et al. | 36/84 |
| 7,337,558 | B2 * | 3/2008 | Terlizzi et al. | 36/8.3 |
| 7,424,783 | B2 * | 9/2008 | Meschter et al. | 36/45 |
| 2005/0081402 | A1 | 4/2005 | Orei et al. | |
| 2006/0162190 | A1 * | 7/2006 | Nishiwaki et al. | 36/97 |

FOREIGN PATENT DOCUMENTS

| | | | |
|---|---|---|---|
| JP | 48-39037 | U | 5/1973 |
| JP | 60-128510 | U | 8/1985 |
| JP | 4-107608 | U | 9/1992 |
| JP | 10-215902 | A | 8/1998 |
| JP | 2000-50907 | | 2/2000 |
| JP | 2002-165611 | | 6/2002 |
| JP | 2002-165611 | A | 6/2002 |
| JP | 2002-209608 | | 7/2002 |
| JP | 2004-230151 | | 8/2004 |
| JP | 3780296 | | 3/2006 |
| JP | 2007-236612 | | 9/2007 |

OTHER PUBLICATIONS

Japanese Office Action (Oct. 6, 2011).

* cited by examiner

*Primary Examiner* — Ted Kavanaugh
(74) *Attorney, Agent, or Firm* — Hamre, Schumann, Mueller & Larson, P.C.

(57) ABSTRACT

A shoe 1 of the present invention includes an upper 2 made of a stretchable fabric. The stretchable fabric is integrated with a sole 3 in a state of being stretched. Further, a method of manufacturing the shoe 1 of the present invention is a method of manufacturing a shoe using a stretchable fabric for the upper 2. The method includes steps of: producing an upper pattern using a last having a size smaller than that of the sole 3 as a base; producing the upper 2 with the stretchable fabric being stretched by stretching the upper pattern and fitting the upper pattern onto a last having a size that matches the sole 3; and integrating the upper 2 with the stretchable fabric being stretched with the sole 3.

7 Claims, 10 Drawing Sheets

A

B

SHOE AND METHOD OF MANUFACTURING THE SAME

FIELD OF THE INVENTION

The present invention relates to a shoe with enhanced fit for a foot and a method of manufacturing the shoe.

DESCRIPTION OF RELATED ART

Conventionally, various efforts have been made to improve the fit between shoes and feet. For example, Patent document 1 discloses a shoe that is improved to provide better fit for a foot by adjusting the tightness of shoelaces and an adjustment band for tightening and loosening the coupling of shoe components. Recently, with consideration given to the constant change of the shape of feet during exercise, shoes that provide improved fit for feet during exercise also have been designed. For example, Patent document 2 discloses a sport shoe that includes an inner side stretchable portion and an outer side stretchable portion that are placed diagonally opposite to each other. The inner side stretchable portion covers part of an inner side surface of the arch of a foot and the outer side stretchable portion covers part of an outer side surface of the foot.

Patent document 1: JP 2000-50907 A

Patent document 2: Japanese Patent 3,780,296 B

SUMMARY OF THE INVENTION

However, the uppers of the shoes disclosed in Patent documents 1 and 2 become wrinkled when feet are bent during exercise, thereby resulting in deterioration of the fit between the shoes and the feet.

With the foregoing in mind, it is an object of the present invention to provide a shoe that provides enhanced fit between the shoe and the foot by reducing the appearance of wrinkles on the shoe upper when the foot is bent during exercise; and a method of manufacturing the shoe.

The shoe of the present invention is a shoe using a stretchable fabric for an upper, wherein the stretchable fabric is integrated with a sole in a state of being stretched.

A method of manufacturing the shoe of the present invention is a method of manufacturing a shoe using a stretchable fabric for an upper, wherein the method comprising steps of producing an upper pattern using a last having a size smaller than that of a sole as a base; producing an upper with the stretchable fabric being stretched by stretching the upper pattern and fitting the upper pattern onto a last having a size that matches the sole; and integrating the upper with the stretchable fabric being stretched with the sole.

According to the shoe of the present invention, when a foot is bent during exercise, the upper responds to a change in the shape of the foot due to shrinkage of the stretchable fabric. Thus, the appearance of wrinkles on the upper is reduced, and thereby the fit between the shoe and the foot is enhanced. Further, the shoe of the present invention preferably can accommodate extensive individual differences in foot size, such as a wide foot and a high instep. Further, a foot looks slim and a rounded shape of the heel remains beautifully in the shoe of the present invention. Thus, the shoe of the present invention provides an excellent appearance.

DESCRIPTION OF THE PREFERRED EMBODIMENTS

Figure 6:
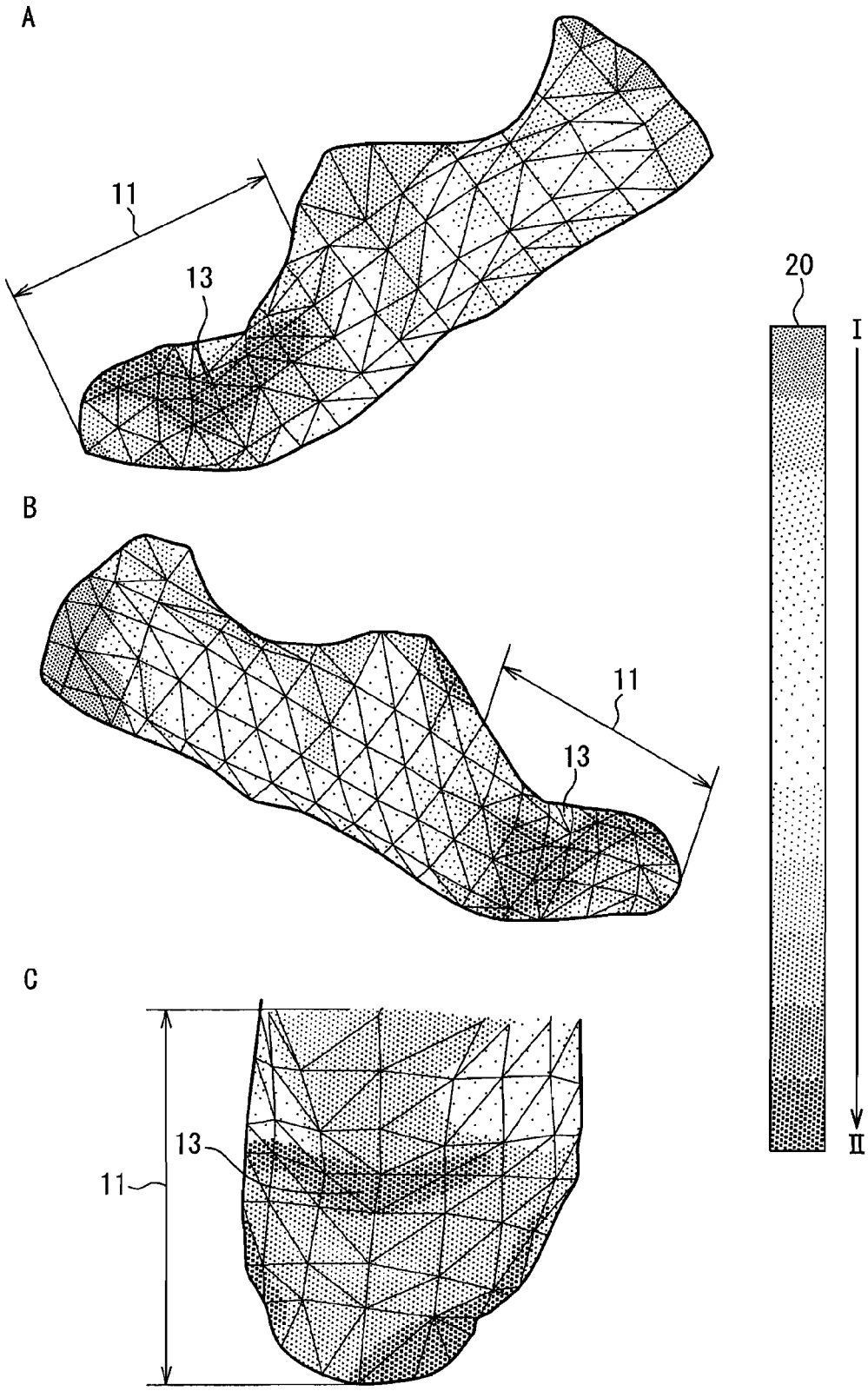
FIG. 6A is a side view of a shoe from an outer instep side, showing the distribution of distortion that occurred on the shoe upper during running.
FIG. 6B is a side view of the shoe shown in FIG. 6A from an inner instep side.
FIG. 6C is a plan view showing a forefoot portion of the shoe shown in FIG. 6A.
Figure 7:
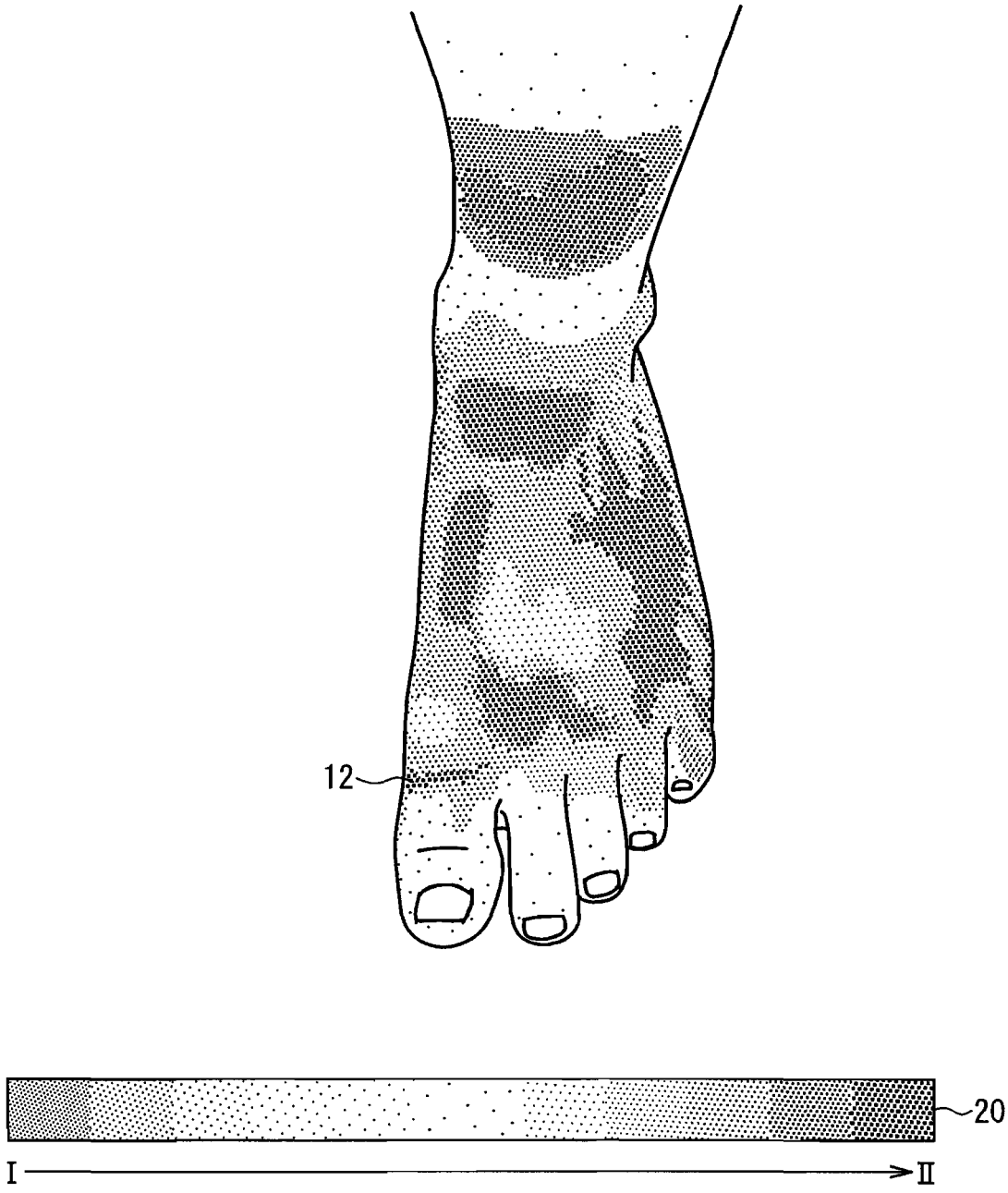
FIG. 7 is a perspective view of a foot, showing the distribution of shrinkage of the skin of the foot during running.
Figure 8:
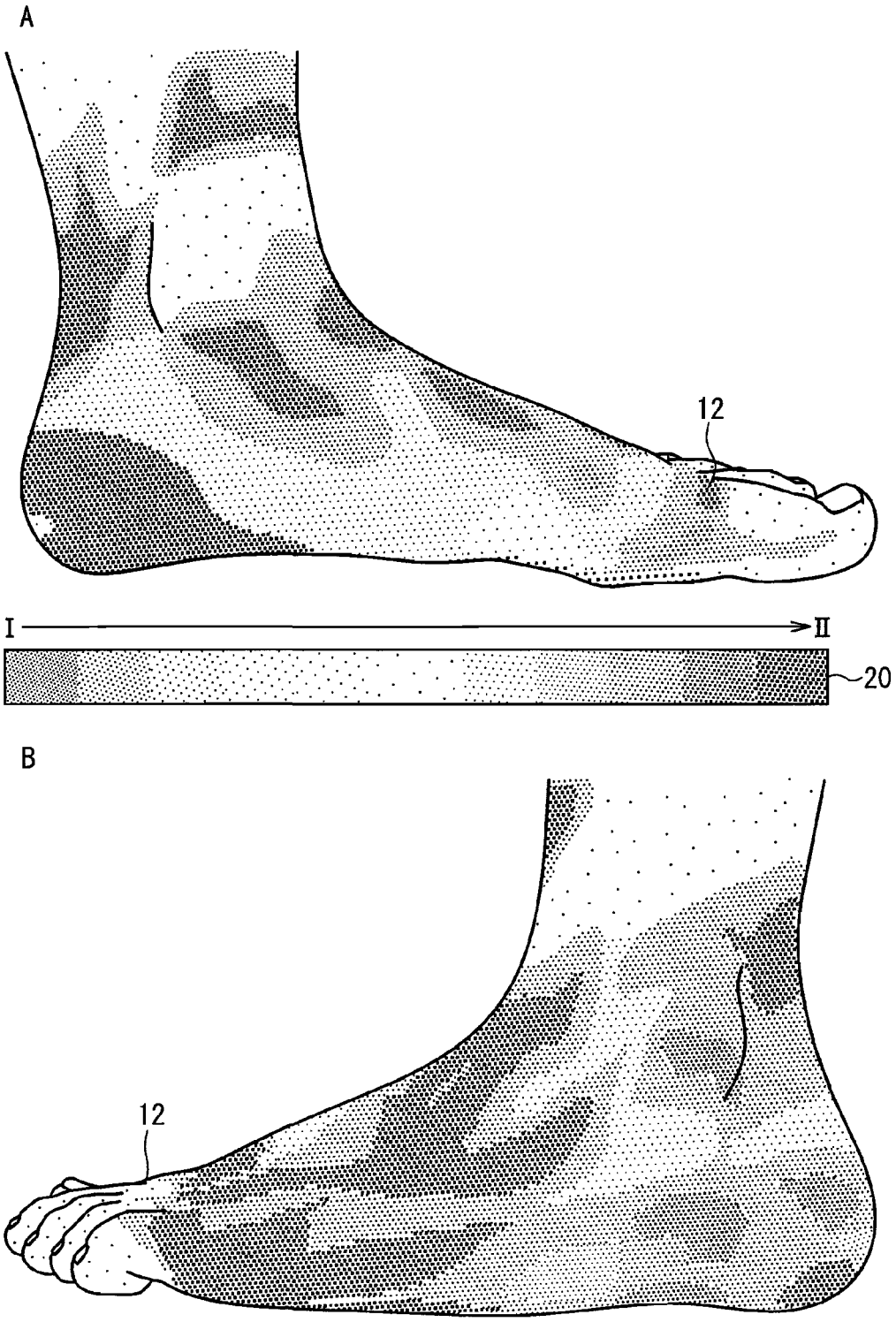
FIG. 8A is a side view of the foot shown in FIG. 7 from the inner instep side.
FIG. 8B is a side view of the foot shown in FIG. 7 from the outer instep side.

In order to solve the problem of deterioration in the fit between a shoe and a foot when the foot is bent during exercise, such as running, the inventors of the present invention analyzed, using a method described in Japanese Patent No. 3,831,348 B, the distribution of distortion of a shoe upper and the distribution of shrinkage of the skin of a foot during running. The results are shown in FIGS. 6 to 8. In FIGS. 6 to 8, a level 20 indicates the level of the distortion or the shrinkage, and the level of the distortion or the shrinkage becomes higher in a direction from I to II. It should be noted that, in FIGS. 6 to 8, portions with the same function are denoted by the same reference numerals.

FIG. 6A is a side view of a shoe from an outer instep side, showing the distribution of distortion that occurred on the shoe upper during running. FIG. 6B is a side view of the shoe shown in FIG. 6A from the inner instep side, and FIG. 6C is a plan view of a forefoot portion of the shoe shown in FIG. 6A. FIG. 7 is a perspective view of a foot, showing the distribution of the shrinkage that occurred on the skin of the foot during running. FIG. 8A is a side view of the foot shown in FIG. 7 from the inner instep side, and FIG. 8B is a side view of the foot shown in FIG. 7 from the outer instep side.

As a result of measuring the distortion that occurred on the shoe upper during running, it was found out that a portion 13 of the shoe upper corresponding to a base of toes 12 had large distortion as shown in FIG. 6. Next, the distribution of the shrinkage that occurred on the skin of the foot during running was checked. As shown in FIGS. 7 and 8, it was found out that the base of toes 12 had a high level of skin shrinkage during running.

Specifically, it was found out that when the foot is bent during running or the like, the portion 13 of the shoe upper shrinks in a range of 10 to 20% in the foot length direction relative to a case where the foot is not bent. Further, it was found out that when the foot is in the air during running (without load) the portion 13 of the shoe upper shrinks in a range of 0 to 8% in a foot width direction in comparison with a case where the foot is on the ground (with load).

From the above results, it seems that the large distortion on the portion 13 of the shoe upper corresponding to the base of toes 12 turns into wrinkles during running, thereby causing deterioration in the fit between the shoe and the foot.

As a result of conducting a keen study on the solutions for the above problem, the inventors of the present invention discovered that by using a stretchable fabric for an upper, and integrating the upper with the stretchable fabric with a sole while being stretched, in other words, allowing the shoe upper to have a shrinking force, the appearance of wrinkles on the shoe upper is reduced when the foot is bent during exercise, such as running, and the fit between the shoe and the foot can be enhanced.

The shoe of the present invention is a shoe using a stretchable fabric for an upper, and the stretchable fabric is integrated with a sole in a state of being stretched. Here, the "state of being stretched" also can mean a state in which the fabric exerts a shrinking force.

It is preferable that the stretchable fabric is stretched in the length direction of the shoe, and it is further preferable that the stretchable fabric is also stretched in the width direction of the shoe. Further, it is preferable that the stretchable fabric is stretched at a tensile rate of from 10 to 40% in the length direction of the shoe and at a tensile rate of from 0 to 30% in the width direction of the shoe. Further, it is more preferable that the stretchable fabric is stretched at a tensile rate of from 10 to 20% in the length direction of the shoe and at a tensile rate of from 0 to 8% in the width direction of the shoe. It is particularly preferable that the stretchable fabric is stretched in the length direction and the width direction of the shoe, and the tensile rate in the length direction of the shoe/the tensile rate in the width direction of the shoe is 1.25 or more. When the stretchable fabric is stretched at a tensile rate of from 10 to 40% in the length direction of the shoe and at a tensile rate of from 0 to 30% in the width direction of the shoe, the balance between a stretching force and a shrinking force of the upper is improved further. Thus, the appearance of wrinkles on the shoe upper is reduced more effectively when the foot is bent during exercise, such as running, and thereby the fit between the shoe and the foot can be enhanced. The stretchable fabric at various portions of the shoe upper may be stretched at the same tensile rate or may be stretched at different tensile rates.

Here, the "tensile rate" indicates a level of being stretched. Specifically, in the length direction of the shoe, assuming that the length of the stretched stretchable fabric in the foot length direction is L1, and the length of the non-stretched stretchable fabric in the foot length direction is L2, the tensile rate is determined by the following equation (1):

$$\text{tensile rate (\%)}=\{(L1-L2)/L1\}\times 100$$

Similarly, in the width direction of the shoe, assuming that the width of the stretched stretchable fabric in the foot width direction is W1, and the width of the non-stretched stretchable fabric in the foot width direction is W2, the tensile rate is determined by the following equation (2):

$$\text{tensile rate (\%)}=\{(W1-W2)/W1\}\times 100$$

It should be noted that the non-stretched state is a state where incisions are made with a cutter or the like in the stretched stretchable fabric of the shoe of the present invention.

Further, it is preferable that a tensile elongation of the stretchable fabric measured in accordance with JIS L 1018 under a load of 20 N (2,041 g)/5 cm is from 30 to 200% in the foot length direction, and from 5 to 100% in the foot width direction. When the stretchable fabric has a tensile elongation of from 30 to 200% in the foot length direction and from 5 to 100% in the foot width direction, the appearance of wrinkles on the shoe upper is reduced more effectively when a foot is bent during exercise, such as running, and thereby the fit between the shoe and the foot can be enhanced. Further, in terms of holding properties of the forefoot portion of the shoe, it is preferable that the stretchable fabric stretches more in the foot length direction than in the foot width direction. In the present invention, the tensile elongation is measured in accordance with JIS L 1018 under the following specific conditions; a distance between grips is 20 cm, and a tensile speed is 20 cm/min.

The stretchable fabric is not particularly limited, and a knitted fabric that itself has stretchability, such as a warp knitted fabric, a circular knitted fabric or a flat knitted fabric, can be used, for example. It is preferable to use a double raschel warp knitted fabric due to its excellent lightweight, air permeability, and durability properties. Further, examples of the stretchable fabric include artificial leather, synthetic leather, and synthetic rubber (polychloroprene rubber) and the like that have stretchability.

A fiber used for manufacturing the stretchable fabric is not particularly limited, and a polyurethane fiber, a polyester fiber, a nylon fiber, a polypropylene fiber, an acrylic fiber, an elastomeric polyurethane fiber, an elastomeric polyester fiber, an elastomeric polyamide fiber, or a mixed fiber thereof can be used, for example. Further, in terms of durability, it is preferable to use a polyester fiber or a mixed fiber containing a polyester fiber, and in terms of stretchability, it is preferable to use an elastomeric polyurethane fiber or a mixed fiber containing an elastomeric polyurethane fiber.

The double raschel warp knitted fabric refers to a warp knitted fabric with a three-layer structure including respective base fabrics for the front surface and the back surface and a connecting yarn for connecting the respective base fabrics. The double raschel warp knitted fabric preferably is knitted by using a warp knitting machine with a double needle line so that the base fabric for one surface is knitted as a derivative weave that is jacquard-controlled so as to include a non-mesh structure part and mesh structure parts and the base fabric for the other surface is knitted as a homogeneous non-mesh structure. The other surface may be formed of one weave and may be formed with different weave mixed. A warp knitting machine for knitting the double raschel warp knitted fabric is commercially available from KARL MAYER Textilmaschinenfabrik GmbH of Germany (including NIPPON MAYER LTD. (a Japan corporation)).

The constituent yarns of the front surface and the back surface of the double raschel warp knitted fabric, and the connecting yarn for connecting the front surface and the back surface are not particularly limited, and a polyurethane yarn, a polyester yarn, a nylon yarn, a polypropylene yarn, an acrylic yarn, an elastomeric polyurethane yarn, an elastomeric polyester yarn, an elastomeric polyamide yarn, and the like can be used. In terms of durability, it is preferable to use a polyester yarn, and it is particularly preferable to use a polyethylene terephthalate yarn. Further, in term of stretchability, it is preferable that a double yarn of a polyester yarn and an elastomeric polyurethane yarn or a covering yarn in which an elastomeric polyurethane yarn is covered with a polyester yarn is used as the constituent yarn of the back surface of the double raschel warp knitted fabric.

The upper may be an upper in which the stretchable fabric is used. It is preferable that one surface of the upper has a non-mesh structure and the other surface has a mesh structure. In terms of appearance and air permeability, it is particularly preferable that the surface having a mesh structure is used as the surface of the shoe. Further, the stretchable fabric may be used to form the entire upper or only a portion of the upper corresponding to a forefoot portion, a tip part of the forefoot portion, or the base of toes.

Although the method of manufacturing a shoe using a stretchable fabric for an upper of the present invention is not particularly limited, it is preferable that the method includes steps of producing an upper pattern using a last having a size smaller than that of a sole as a base; producing an upper with the stretchable fabric being stretched by stretching the upper pattern and fitting the upper pattern onto a last having a size that matches the sole; and integrating the upper with the stretchable fabric stretched with the sole.

It is preferable that a difference in size between the last having a size smaller than that of the sole and the sole is from 1 to 5 cm. When the difference in size between the last having a size smaller than that of the sole and the sole is less than 1 cm, distortion that occurs on the shoe upper during exercise, such as running, cannot be absorbed sufficiently, and thus the appearance of wrinkles on the shoe upper tends not to be eliminated effectively. Further, when the difference in size between the last having a size smaller than that of the sole and the sole is more than 5 cm, there is a tendency for sewing of the shoe upper and reinforcing members together to become difficult when manufacturing the shoe.

A method of manufacturing the upper is not particularly limited, and a standard French seaming method, a treasure method, a lasting method and the like can be used. Further, a method of integrating the upper with the sole is also not particularly limited, and the upper and the sole can be integrated together using a standard cemented method, for example.

It is preferable that a toecap portion, a heel portion, and eyelet portions of the shoe of the present invention respectively are reinforced with artificial leather. By reinforcing these portions, it is possible to maintain the shape of the shoe and the holding properties. Among the above-mentioned portions, the heel portion may not be reinforced in the case where reduced-weight is particularly important. Further, the surface of the shoe upper may be decorated as needed.

EXAMPLES

Figure 1:
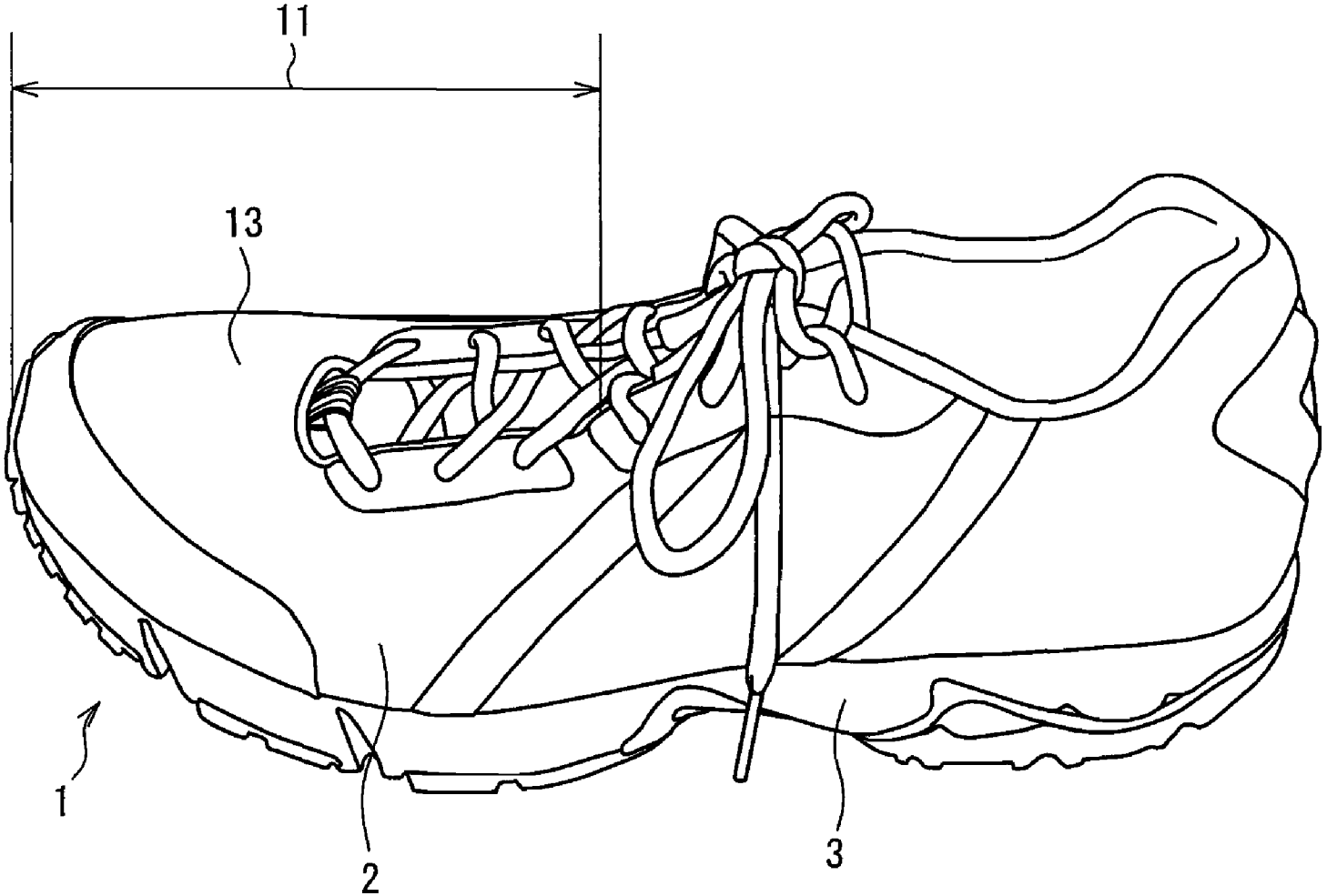
FIG. 1 is a side view showing a shoe of Example 1.
Figure 2:
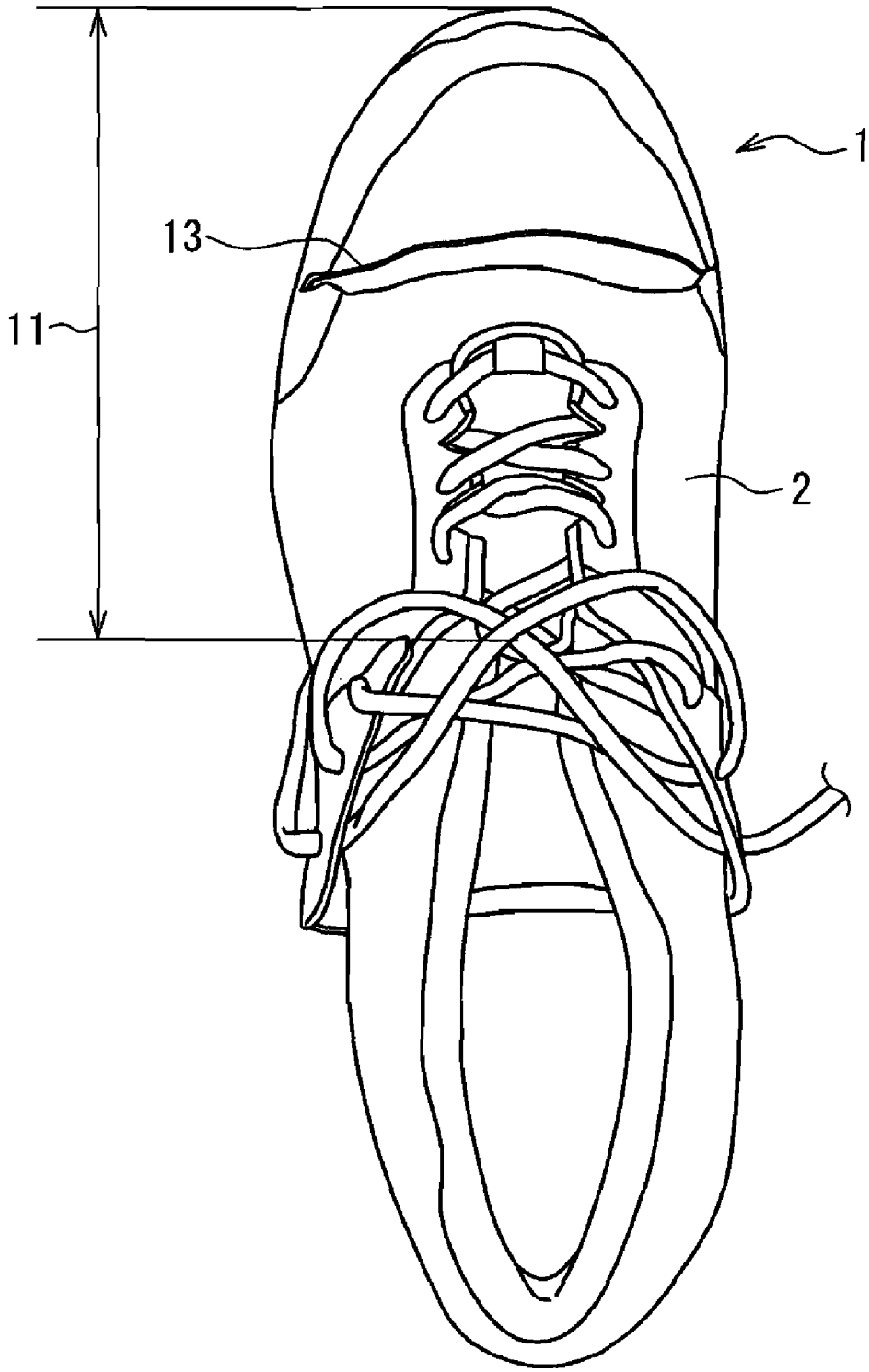
FIG. 2 is a plan view showing the shoe of Example 1 in a case where an incision is made substantially perpendicularly to a foot length direction in a portion of the shoe upper corresponding to the base of toes.
Figure 3:
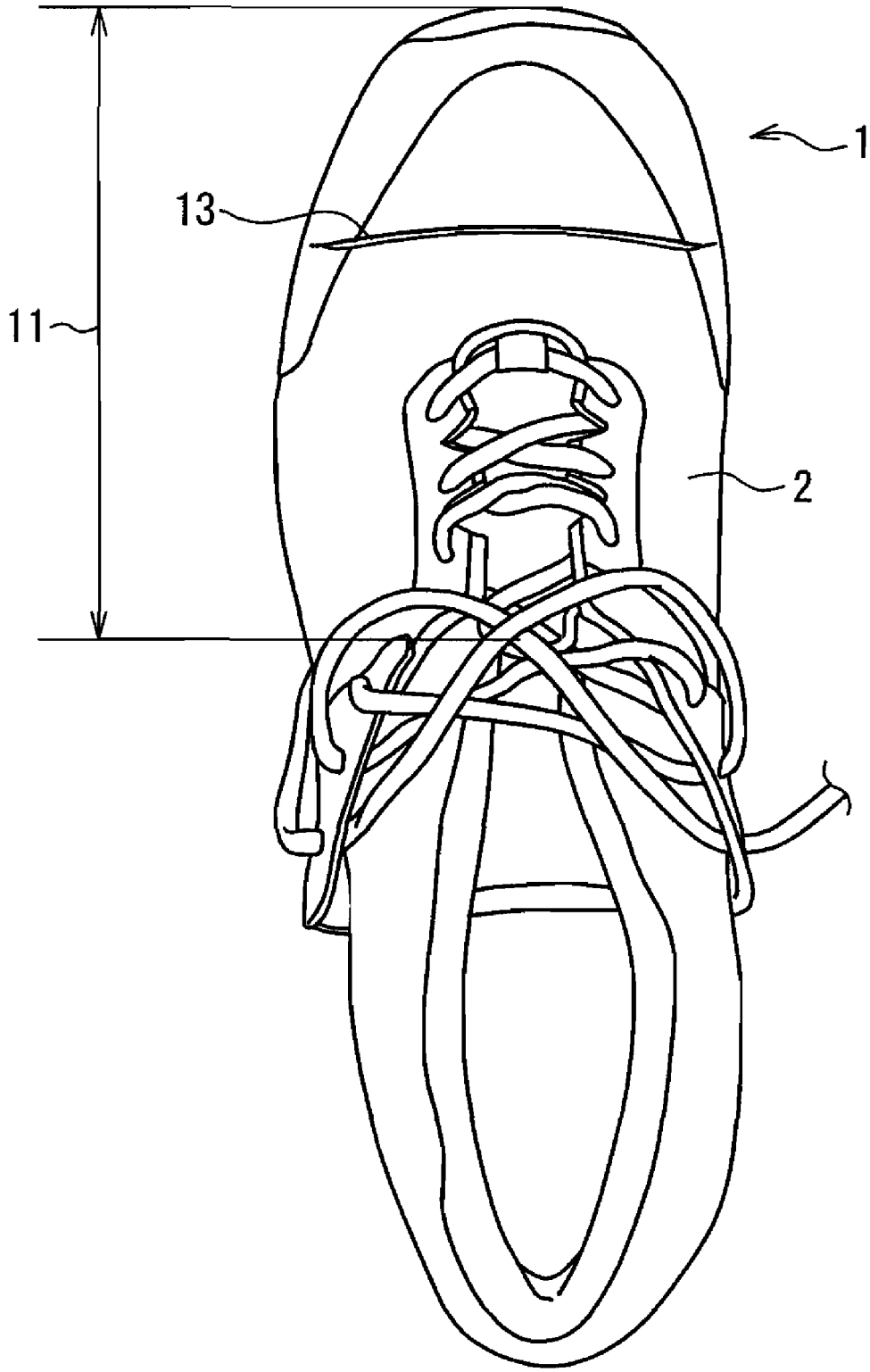
FIG. 3 is a plan view showing a shoe of Comparative example 1 in a case where an incision is made substantially perpendicularly to the foot length direction in a portion of the shoe upper corresponding to the base of toes.
Figure 4:
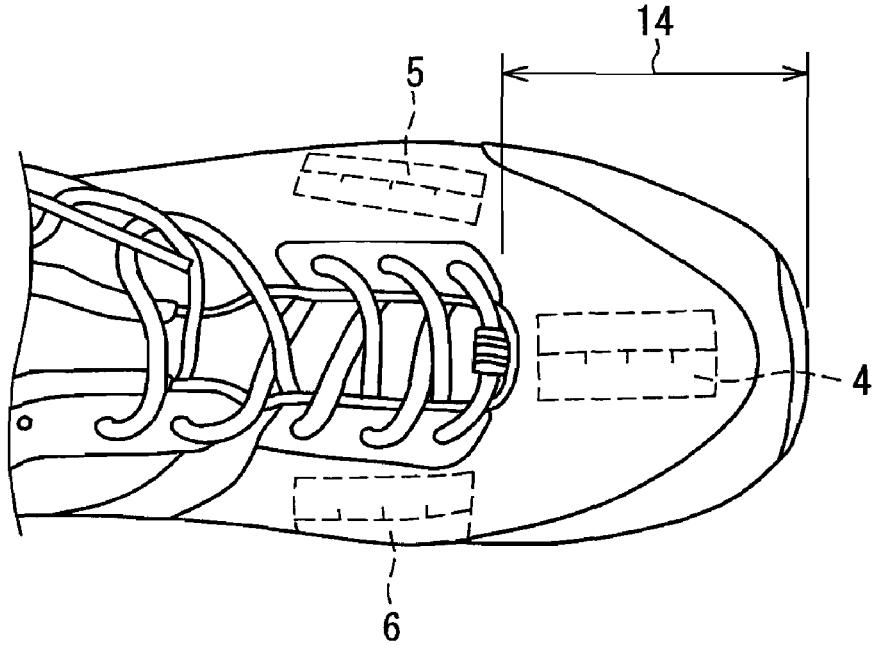
FIG. 4A is a partial top view of the shoe of Example 1 of the present invention, showing a stretchable fabric piece used to measure a tensile rate.
FIG. 4B is a partial top view of the shoe of Example 1 of the present invention, showing a case where incisions are made substantially perpendicularly to the foot length direction in the stretchable fabric piece used to measure a tensile rate shown in FIG. 4A.
Figure 4:
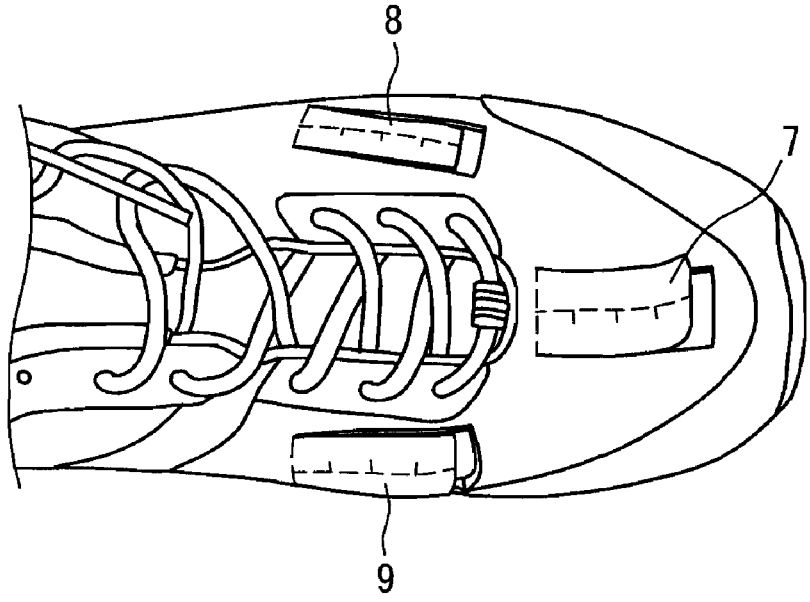
Figure 5:
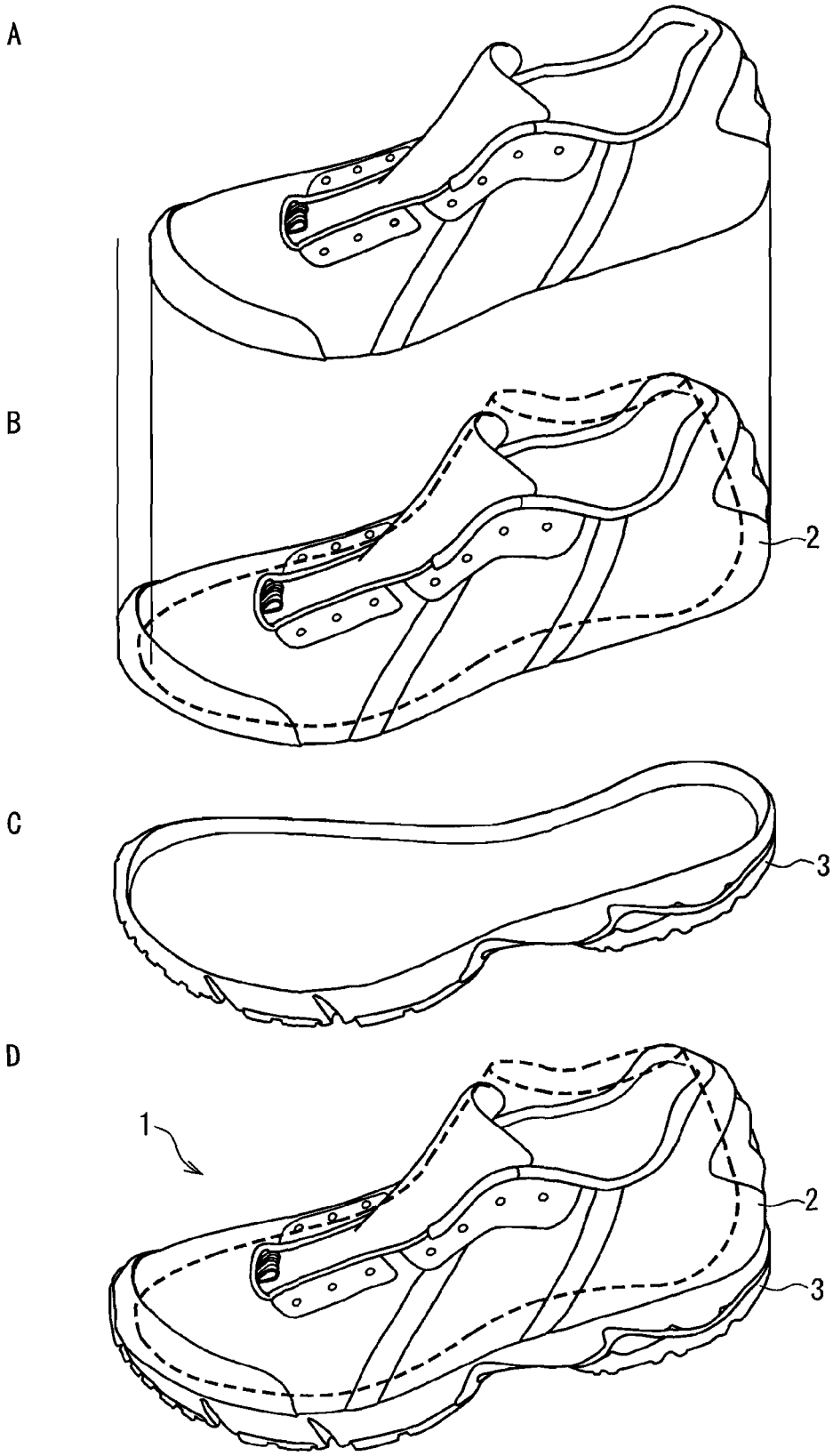
FIGS. 5A-D show schematic views for describing manufacturing steps of the shoe of Example 1 of the present invention.
Figure 9:
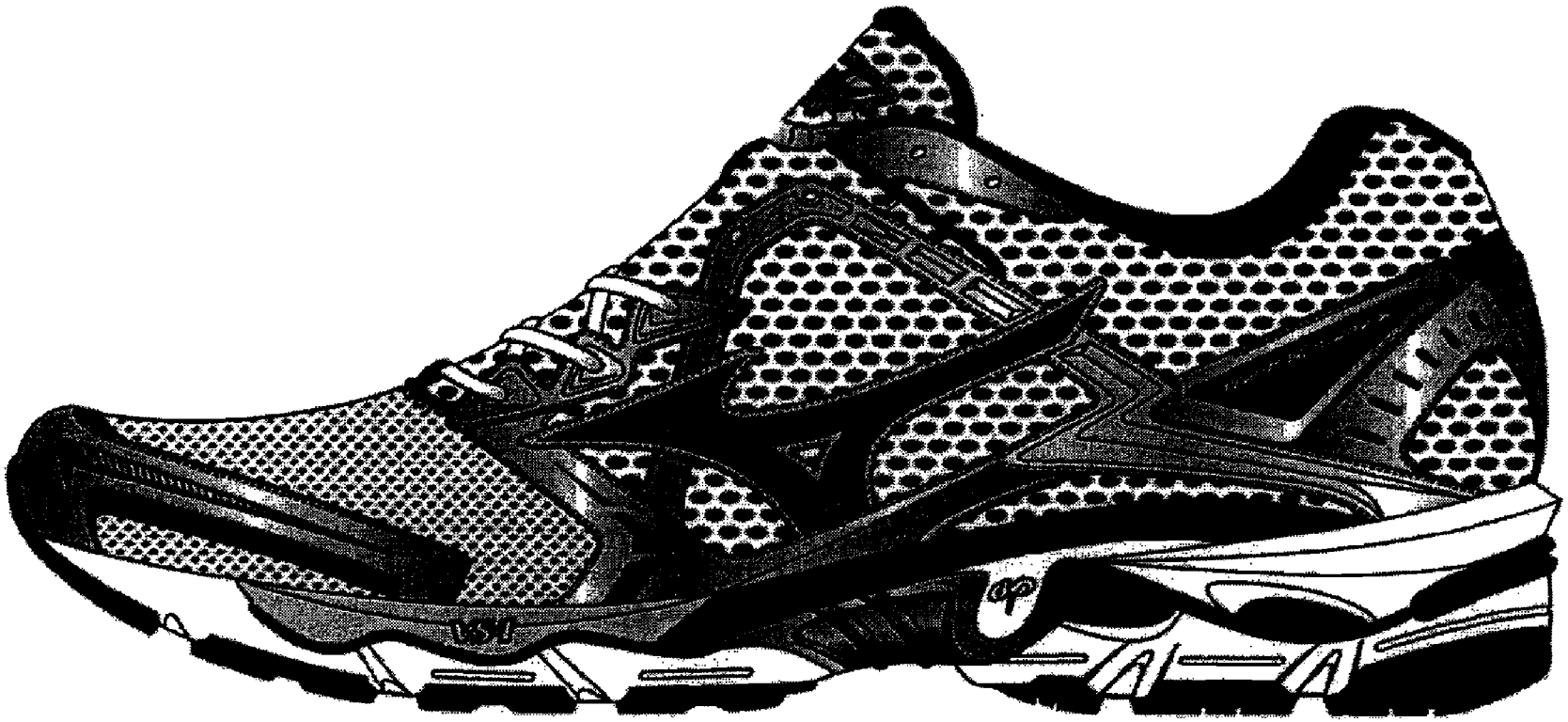
FIG. 9 is a side view showing a shoe of Example 6 of the present invention.
Figure 10:
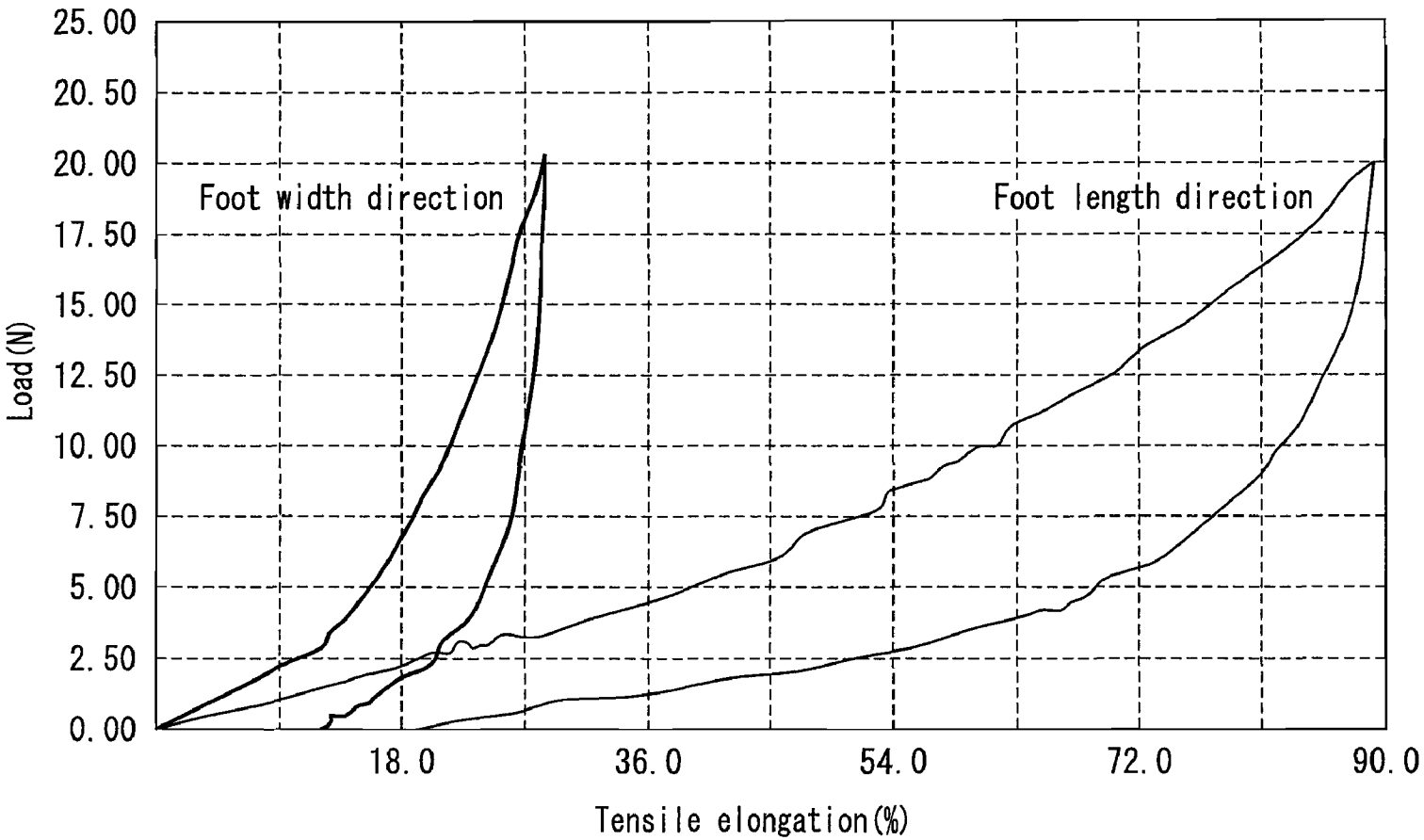
FIG. 10 is a graph showing a tensile elongation of a double raschel warp knitted fabric of Manufacturing Example 2 measured in accordance with JIS L 1018.

Hereinafter, the shoe and the method of manufacturing the shoe of the present invention will be described on the basis of Examples and the drawings, although the present invention is not limited thereto. FIG. 1 is a side view showing a shoe of Example 1 of the present invention. FIG. 2 is a plan view showing the shoe of Example 1 in a case where an incision is made substantially perpendicularly to the foot length direction in a portion of the shoe upper corresponding to the base of toes. FIG. 3 is a plan view showing a shoe of Comparative Example 1 in a case where an incision is made substantially perpendicularly to the foot length direction in a portion of the shoe upper corresponding to the base of toes. FIG. 4A is a partial top view of the shoe of Example 1 of the present invention showing a stretchable fabric piece used to measure a tensile rate. FIG. 4B is a partial top view of the shoe of Example 1 of the present invention, showing a case where incisions are made substantially perpendicularly to the foot length direction in the stretchable fabric used to measure a tensile rate shown in FIG. 4A. FIGS. 5A-D show schematic views for describing manufacturing steps of the shoe of Example 1 of the present invention. FIG. 9 is a side view showing a shoe of Example 6 of the present invention. FIG. 10 is a graph showing a tensile elongation of a double raschel warp knitted fabric of Manufacturing Example 2 measured in accordance with JIS L 1018. It should be noted that, in FIGS. 1 to 5, portions with the same function are denoted by the same reference numerals.

Manufacturing Example 1

A double yarn (an amount of yarn: 62 g/m$^2$) of a multifilament fiber yarn made of polyester (total size of fibers: 75 dtex, number of filaments: 36, and mixing ratio: 10 mass %) and a multifilament fiber yarn made of polyester (total size of fibers: 75 dtex, number of filaments: 36, and mixing ratio: 10 mass %) was used as a constituent yarn of a front surface. Further, a double yarn (an amount of yarn: 103 g/m$^2$) of a multifilament fiber yarn made of polyester (total size of fibers: 75 dtex, number of filaments: 36, and mixing ratio: 27 mass %) and a monofilament fiber yarn made of elastomeric polyurethane (total size of fibers: 70 dtex, number of filaments: 1, and mixing ratio: 20 mass %) was used as a constituent yarn of a back surface. A monofilament fiber yarn made of polyester (total size of fibers: 30 dtex, number of filaments: 1, mixing ratio: 33 mass %, and an amount of yarn: 147 g/m$^2$) was used as a connecting yarn for connecting the front surface and the back surface. A double raschel warp knitted fabric was knitted using these yarns. The "mixing ratio" refers to a mass % of each yarn when the total of the yarns in the double raschel warp knitted fabric is 100 mass %. In the double raschel warp knitted fabric, the back surface has a non-mesh knit structure, and the front surface includes a mesh-structured portion and a non-mesh structured portion. The thickness of the knitted double raschel warp knitted fabric was 3 mm. The gage of a knitting machine used to knit the double raschel warp knitted fabric was 22 gages, and the weight per unit area of the entire knitted fabric was 312 g/m$^2$. This double raschel warp knitted fabric was used as a stretchable fabric. Further, a tensile elongation of the double raschel warp knitted fabric was examined in accordance with JIS L 1018 under a load of 20 N/5 cm. The tensile elongation in the foot length direction was 57% and the tensile elongation in the foot width direction was 33%.

Manufacturing Example 2

A double yarn (an amount of yarn: 160 g/m$^2$) of a multifilament fiber yarn made of polyester (total size of fibers: 150 dtex, number of filaments: 48, and mixing ratio: 37 mass %) and a nylon yarn (total size of fibers: 200 dtex, number of filaments: 24, and mixing ratio: 3 mass %) was used as a constituent yarn of a front surface. Further, a double yarn (an amount of yarn: 157 g/m$^2$) of a nylon yarn (total size of fibers: 100 dtex, number of filaments: 24, and mixing ratio: 26 mass %) and a monofilament fiber yarn made of elastomeric polyurethane (total size of fibers: 140 dtex, number of filaments: 1, and mixing ratio: 13 mass %) was used as a constituent yarn of a back surface. A monofilament fiber yarn made of polyester (total size of fibers: 30 dtex, number of filaments: 1, mixing ratio: 21 mass %, and an amount of yarn: 84 g/m$^2$) was used as a connecting yarn for connecting the front surface and the back surface. By using these yarns, a double raschel warp knitted fabric of Manufacturing Example 2 was obtained in the same manner as Manufacturing Example 1, except that the weight per unit area of the entire knitted fabric was changed to 401 g/m$^2$. Further, the tensile elongation of the double raschel warp knitted fabric of Manufacturing Example 2 was examined in accordance with JIS L 1018 under a load of 20 N/5 cm, and the results are shown in FIG. 10. As can be seen from FIG. 10, the tensile elongation in the foot length direction was 89%, and the tensile elongation in the foot width direction was 28%.

Example 1

A shoe of Example 1 was produced using the double raschel warp knitted fabric knitted in Manufacturing Example 1 as a stretchable fabric. First, by using the double raschel warp knitted fabric of Manufacturing Example 1, an upper pattern as shown in FIG. 5A was produced using a last of 24 cm as its base, and was sewn. Then, as shown in FIG. 5B, the upper pattern was stretched and fit onto a last of 27 cm to produce an upper 2 with the stretchable fabric being stretched. Next, an adhesive was applied on the undersurface of the upper 2 with the stretchable fabric being stretched and on a top surface of a sole 3 of 27 cm shown in FIG. 5C. Then, as shown in FIG. 5D, the undersurface of the upper 2 and the top surface of the sole 3 covered with the adhesive were put together, and were integrated together by crimping. As a result, a shoe similar to that shown in FIG. 1 was produced. Similarly to producing an upper of a normal shoe, reinforced portions, such as a toecap portion, a heel portion, and eyelet portions, were provided in accordance with the design of the shoe when producing the upper pattern.

Example 2

A shoe of Example 2 was produced in the same manner as Example 1 except that an upper pattern was produced using a last of 22.5 cm as its base.

Example 3

A shoe of Example 3 was produced in the same manner as Example 1 except that an upper pattern was produced using a last of 25.5 cm as its base.

Example 4

A shoe of Example 4 was produced in the same manner as Example 1 except that an upper pattern was produced using a stretchable fabric that has a tensile elongation of 57% in the foot length direction and 7% in the foot width direction according to an examination performed in accordance with JIS L 1018 under a load of 20 N/5 cm, and also using a last of 24 cm in the length direction and 27 cm in the width direction as its base.

Example 5

A shoe of Example 5 was produced in the same manner as Example 1 except that an upper pattern was produced using a stretchable fabric that has a tensile elongation of 57% in the foot length direction and 57% in the foot width direction according to an examination performed in accordance with JIS L 1018 under a load of 20 N/5 cm, and also using a last of 24 cm in the length direction and 22 cm in the width direction as its base.

Example 6

A shoe of Example 6 was produced using the double raschel warp knitted fabric knitted in Manufacturing Example 2 as a stretchable fabric. The shoe of Example 6 was produced in the same manner as Example 1 except that an upper pattern was produced using a last of 22 cm in the length direction and 27 cm in the width direction. In Example 6, the stretchable fabric was used only for a tip part 14 of a forefoot portion of the shoe, and a non-stretchable fabric was used for the other portions.

Comparative Example 1

In Comparative Example 1, a shoe having a size of 27 cm was produced using the double raschel warp knitted fabric knitted in Manufacturing Example 1 as a stretchable fabric. The shoe of Comparative Example 1 was produced in the same manner as Example 1 except that an upper pattern was produced using a last of 27 cm as its base.

FIGS. 2 and 3 show the shoes of Example 1 and Comparative Example 1, respectively. In each shoe, an incision is made substantially perpendicularly to the foot length direction in a portion 13 of the shoe upper corresponding to a base of toes 12. As can be seen from FIGS. 2 and 3, in the shoe of Comparative Example 1, there is no gap at the portion 13 of the upper in which an incision was made. In contrast, in the shoe of Example 1, there is a gap of about 5 mm at the portion 13 of the upper in which an incision was made. In the same manner, an incision was made in the portions 13 of the uppers of the shoes of Example 2 to 5, and they had a gap of about 5.5 mm, 4.5 mm, 5 mm, and 5 mm, respectively. This indicates that the stretchable fabrics used for the uppers in the shoes of Example 1 to 5 were stretched.

Measurement of Tensile Rate

As shown in FIG. 4A, a stretchable fabric piece 4, in other words, the stretch fabric 4 in a state of being stretched having a size of 40 mm in length (L1) and 20 mm in width (W1) was cut from a tip part of a forefoot portion 11 of the upper of the shoe of Example 1. Then, a stretchable fabric piece 7 after being cut and not in a state of being stretched as shown in FIG. 4B was measured in length (L2) and width (W2). The length and the width were 35 mm and 19 mm, respectively. The tensile rate at which the stretchable fabric constituting the tip part of the forefoot portion 11 of the shoe of Example 1 was stretched in the length direction of the shoe was determined using the equation (1):

$$\text{tensile rate (\%)}=\{(L1-L2)/L1\}\times 100$$

As a result, the tensile rate was 13%.

Similarly, the tensile rate at which the stretchable fabric constituting the tip part of the forefoot portion 11 of the shoe of Example 1 was stretched in the width direction of the shoe was determined using the equation (2):

$$\text{tensile rate (\%)}=\{(W1-W2)/W1\}\times 100$$

As a result, the tensile rate was 5%.

Further, as shown in FIG. 4A, a stretchable fabric piece 5 having a size of 40 mm in length (L1) and 20 mm in width (W1) was cut in a state of being stretched from an outer part of the forefoot portion 11 of the upper of the shoe of Example 1. Then, a stretchable fabric piece 8 after being cut and not in a state of being stretched as shown in FIG. 4B was measured in length and width. The length and the width were 35 mm (L2) and 19 mm (W2), respectively. That is, the tensile rates at which the stretchable fabric constituting the outer part of the forefoot portion 11 of the shoe of Example 1 was stretched was 13% in the length direction of the shoe and 5% in the width direction of the shoe.

Further, as shown in FIG. 4A, a stretchable fabric piece 6 having a size of 40 mm in length (L1) and 20 mm in width (W1) was cut in a state of being stretched from an inner part of the forefoot portion 11 of the upper of the shoe of Example 1. Then, a stretchable fabric piece 9 after being cut and not in a state of being stretched as shown in FIG. 4B was measured in length and width. The length and the width were 35 mm (L2) and 19 mm (W2), respectively. That is, the tensile rates at which the stretchable fabric constituting the inner part of the forefoot portion 11 of the shoe of Example 1 was stretched was 13% in the length direction of the shoe and 5% in the width direction of the shoe.

In the same manner, the tensile rates of the stretchable fabric constituting the upper of each of the shoes of Example 2 to 5 were measured. As a result, the tensile rates at which the stretchable fabrics constituting the respective tip parts of the forefoot portions 11 of the shoes of Example 2 to 5 were stretched were 15%, 10%, 13%, and 13% in the length direction of the shoes, respectively, and 8%, 3%, 0% and 15% in the width direction of the shoes, respectively. The tensile rates at which the stretchable fabrics constituting the respective outer parts of the forefoot portions 11 of the shoes of Example 2 to 5 were stretched were 15%, 10%, 13%, and 13% in the length direction of the shoes, respectively, and 8%, 3%, 0% and 15% in the width direction of the shoes, respectively. The tensile rates at which the stretchable fabrics constituting the respective inner parts of the forefoot portions 11 of the shoes of Example 2 to 5 were stretched were 15%, 10%, 13%, and 13% in the length direction of the shoes, respectively, and 8%, 3%, 0% and 15% in the width direction of the shoes, respectively.

As is evident from the above, in the shoes of Examples 1 to 5, the stretchable fabric was stretched at the same tensile rate in each of the measured portions.

In the same manner, the tensile rates of the stretchable fabric constituting the upper of the shoe of Example 6 were measured. As a result, the tensile rates at which the stretchable fabric constituting the tip part 14 of the forefoot portion of the shoe of Example 6 was stretched was 16.7% in the length direction of the shoe and 0% in the width direction of the shoe. It should be note that since a non-stretchable fabric was used for all of the portions except the tip part 14 of the forefoot portion of the shoe, only the fabric of the tip part of the forefront portion of the shoe was in a state of being stretched.

Fitting Test

Test subjects wearing the shoes of Example 1 and Comparative Example 1 respectively participated in running for about 1 minute at 10 km/h, and levels of wrinkles on the shoe uppers and fit between the shoes and the feet at the time of the running were evaluated on the basis of the following criteria. The results are shown in TABLE 1. The shoes of Example 1 and Comparative Example 1 were worn respectively by ten test subjects.

Level of Wrinkles

Pictures of the shoe uppers at the time of the running were taken with a high-speed camera, and the levels of wrinkles that appeared on the shoe uppers were observed and evaluated.

A The level of the appearance of wrinkles was small

B The level of the appearance of wrinkles was large

Fit

With reference to the shoe of Comparative Example 1, the fit between each of the shoes and the entire foot, and the fit between each of the shoes and each portion of the foot were evaluated on a 1-to-5 scale using a paired comparison method.

5 good 4 somewhat good 3 same 2 somewhat bad 1 bad

TABLE 1

| | Level of | Fit | | | | |
|---|---|---|---|---|---|---|
| | Appearance of wrinkles | Forefoot portion | Instep portion | Arch portion | Heel portion | Entire foot |
| Example 1 | A | 4.8 | 3.4 | 3.3 | 4 | 4.1 |
| Comparative Example 1 | B | 3 | 3 | 3 | 3 | 3 |

As can be seen from TABLE 1, in the shoe of Comparative Example 1, the level of wrinkles that appeared on the shoe upper was large and the fit between the shoe and the foot was bad when the foot was bent during the running. In contrast, in the shoe of Example 1, the level of wrinkles that appeared on the shoe upper was small, and the fit between the shoe and the foot was enhanced. In particular, the fit between the shoe and the forefoot portion of the foot was enhanced. Further, since the rounded shape of the heel can remain beautifully, the fit between the shoe and the heel portion was also enhanced. This is because the stretchable fabric was being stretched in the upper of the shoe of Example 1. Thus, when the foot is bent during exercise, such as running, it seems that the upper responds to a change in the shape of the foot due to shrinkage of the stretchable fabric, and thereby the appearance of wrinkles on the upper is reduced, and the fit between the shoe and the foot is enhanced.

Similarly, in each of the shoes of Examples 2 to 5, the level of wrinkles that appeared on the shoe upper was small when the foot was bent during exercise, such as running, and the fit between the shoe and the foot was enhanced. Furthermore, the shoe of Example 4, whose tensile rate in the width direction of the shoe is 0%, had excellent holding properties in the width direction of the shoe. Moreover, in the shoe of Example 5, whose tensile rate in the shoe width direction is 15%, slimness at the time of wearing the shoe was improved, and the appearance was good.

Similarly, in the shoe of Example 6 in which the stretchable fabric was used only for the tip part of the forefoot portion thereof, the level of wrinkles that appeared on the shoe upper was small when the foot was bent during exercise, such as running, and the fit between the shoe and the foot was enhanced. Also, the shoe had excellent holding properties in the width direction.

The shoes of Examples 1 to 6 can accommodate extensive individual differences in foot size, such as a wide foot and a high instep. Furthermore, the uppers were prevented from being loose, and the feet looked slim in the shoes, thereby providing an excellent appearance.

The present invention can be used for various sport shoes such as running shoes, walking shoes, and athletic shoes including volleyball shoes and basketball shoes. Further, the present invention can be used for leisure shoes.

The invention may be embodied in other forms without departing from the spirit of essential characteristics thereof. The embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

What is claimed is:

1. A shoe comprising a sole and an upper, at least a part of the upper including a stretchable fabric, the stretchable fabric having a tensile elongation of 30 to 200% in a foot length direction and 5 to 100% in a foot width direction when examined under a load of 20 N/5 cm, the upper being integrated with the sole with the stretchable fabric being stretched in a length direction of the shoe at a tensile rate of 10 to 40%, the stretchable fabric being stretched in a length direction and a width direction of the shoe, and a ratio between a tensile rate in the length direction of the shoe and a tensile rate in the width direction of the shoe is 1.25 or more.

2. The shoe according to claim 1, wherein the tensile rate in the width direction of the shoe is from 0 to 30%.

3. The shoe according to claim 1, wherein the tensile rate in the length direction of the shoe is from 10 to 20% and the tensile rate in the width direction of the shoe is from 0 to 8%.

4. The shoe according to claim 1, wherein the stretchable fabric is a double raschel warp knitted fabric.

5. The shoe according to claim 4, wherein a constituent yarn of a back surface of the double raschel warp knitted fabric is a double yarn of a polyester yarn and an elastomeric polyurethane yarn.

6. The shoe according to claim 1, wherein the stretchable fabric is used only for a portion of the upper corresponding to a forefoot portion, a tip part of the forefoot portion, or a base of toes.

7. A method of manufacturing a shoe using a stretchable fabric for an upper, wherein the method comprises steps of:

producing an upper pattern using a last having a size smaller than that of a sole as a base;

producing an upper with the stretchable fabric being stretched by stretching the upper pattern and fitting the upper pattern onto a last having a size that matches the sole; and integrating the upper with the stretchable fabric being stretched with the sole, the stretchable fabric being stretched in a length direction of the shoe at a tensile rate of 10 to 40%, the stretchable fabric having a tensile elongation of 30 to 200% in a foot length direction and 5 to 100% in a foot width direction when examined under a load of 20 N/5 cm, the stretchable fabric is stretched in a length direction and a width direction of the shoe, and a ratio between a tensile rate in the length direction of the shoe and a tensile rate in the width direction of the shoe is 1.25 or more.

* * * * *